US005693903A

United States Patent [19]

Heidorn et al.

[11] Patent Number: 5,693,903

[45] Date of Patent: Dec. 2, 1997

[54] APPARATUS AND METHOD FOR ANALYZING VOCAL AUDIO DATA TO PROVIDE ACCOMPANIMENT TO A VOCALIST

[75] Inventors: Allen J. Heidorn, Minnetonka; John W. Paulson, Edina; Mark E. Dunn, Apple Valley, all of Minn.

[73] Assignee: Coda Music Technology, Inc., Eden Prairie, Minn.

[21] Appl. No.: 628,126

[22] Filed: Apr. 4, 1996

[51] Int. Cl.[6] ..... G10H 1/40; G10H 5/00

[52] U.S. Cl. ..... 84/668; 84/609; 84/636; 84/645

[58] Field of Search ..... 84/612, 636, 652, 84/668, 609, 610, 634, 635, 650, 651, 666, 663

[56] References Cited

U.S. PATENT DOCUMENTS

| | | | |
|---|---|---|---|
| 4,471,163 | 9/1984 | Donald et al. . | |
| 4,546,687 | 10/1985 | Minami . | |
| 4,562,306 | 12/1985 | Chou et al. . | |
| 4,593,353 | 6/1986 | Pickholtz . | |
| 4,602,544 | 7/1986 | Yamada et al. . | |
| 4,621,321 | 11/1986 | Boebert et al. . | |
| 4,630,518 | 12/1986 | Usami . | |
| 4,651,612 | 3/1987 | Matsumoto . | |
| 4,685,055 | 8/1987 | Thomas . | |
| 4,688,169 | 8/1987 | Joshi . | |
| 4,740,890 | 4/1988 | William . | |
| 4,745,836 | 5/1988 | Dannenberg . | |
| 5,034,980 | 7/1991 | Kubota . | |
| 5,056,009 | 10/1991 | Mizuta . | |
| 5,113,518 | 5/1992 | Durst, Jr. et al. . | |
| 5,131,091 | 7/1992 | Mizuta . | |
| 5,138,926 | 8/1992 | Stier et al. . | |
| 5,241,128 | 8/1993 | Imaizumi et al. . | |
| 5,453,569 | 9/1995 | Saito et al. . | |
| 5,455,378 | 10/1995 | Paulson et al. | 84/634 X |
| 5,488,196 | 1/1996 | Zimmerman et al. | 84/612 |
| 5,491,751 | 2/1996 | Paulson et al. . | |
| 5,521,323 | 5/1996 | Paulson et al. . | |
| 5,521,324 | 5/1996 | Dannenberg et al. | 84/612 |
| 5,557,056 | 9/1996 | Hong et al. | 84/634 X |
| 5,585,585 | 12/1996 | Paulson et al. . | |

FOREIGN PATENT DOCUMENTS

| | | |
|---|---|---|
| 0 488 732 | 6/1992 | European Pat. Off. . |
| 0 521 487 | 1/1993 | European Pat. Off. . |

OTHER PUBLICATIONS

P. Allen et al., "Tracking Musical Beats in Real Time," *ICMC Glascow 1990 Proceedings,* (1990), pp. 140–143.

J. Bloch et al., "Real–Time Computer Accompaniment of Keyboard Performances," *Proceedings of International Computer Music Conference,* (1985), pp. 279–290.

W. Buxton et al., "The Computer as Accompanist," *CHI '86 Proceedings,* (Apr. 1986), pp. 41–43.

(List continued on next page.)

*Primary Examiner*—William M. Shoop, Jr.
*Assistant Examiner*—Jeffrey W. Donels
*Attorney, Agent, or Firm*—Merchant, Gould, Smith, Edell, Welter & Schmidt, PA

[57] ABSTRACT

A system for interpreting the requests and performance of a vocal soloist, stated in the parlance of the musician and within the context of a specific published edition of music the soloist is using, to control the performance of a digitized musical accompaniment. Sound events and their associated attributes are extracted from the soloist vocal performance and are numerically encoded. The pitch, duration and event type of the encoded sound events are then compared to a desired sequence of the performance score to determine if a match exists between the soloist performance and the performance score. Variations in pitch due to vibrato are distinguished from changes in pitch due to the soloist moving from one note to another in the performance score. If a match exists between the soloist vocal performance and the performance score, the system instructs a music synthesizer module to provide an audible accompaniment for the vocal soloist.

20 Claims, 13 Drawing Sheets

OTHER PUBLICATIONS

P. Capell et al., "Instructional Design and Intelligent Tutoring: Theory and the Precision of Design," *Jl. of Artificial Intelligence in Education,* (1993) 4(1), pp. 95–121.
R. Dannenberg, "Music Representation Issues, Techniques, and Systems," *Computer Music Journal,* 17:3 (Fall 1993), pp. 20–30.
R. Dannenberg et al., "Results from the Piano Tutor Project," *The Fourth Biennial Arts & Technology Symposium,* Connecticut College (Mar. 1993), pp. 143–149.
R. Dannenberg, "Software Support for Interactive Multimedia Performance," *Interface,* vol. 22 (1993), pp. 213–228.
R. Dannenberg et al., "Human–Computer Interaction in the Piano Tutor," *Multimedia Interface Design,* (1992), pp. 65–78.
R. Dannenberg et al., "Practical Aspects of a Midi Conducting Program," *Proceedings of International Computer Music Conference,* (1991), pp. 537–540.
R. Dannenberg, "Software Support for Interactive Multimedia Performance," *Proceedings The Arts and Technology* 3, The Center for Art and Technology at Connecticut College, (1991), pp. 148–156.
R. Dannenberg, *Real–Time Computer Accompaniment,* Copyright 1990 Roger B. Dannenberg, Handout at Accoustical Society of America May 1990, pp. 1–10.
R. Dannenberg et al., "An Expert System for Teaching Piano to Novices," *ICMC Glasgow Proceedings,* (1990), pp. 20–23.
R. Dannenberg, "Recent work in real–time music understanding by computer," *Music, Language, Speech and Brain,* Wenner–Gren International Symposium Series, vol. 59, (1990), pp. 194–202.
R. Dannenberg, "Real Time Control For Interactive Computer Music and Animation," *The Arts & Technology II: A Symposium,* Connecticut College, (1989), pp. 85–95.
R. Dannenberg, "Real–Time Scheduling and Computer Accompaniment," *Current Directions in Computer Music Research,* (1989), pp. 225–261.
R. Dannenberg et al., "New Techniques for Enhanced Quality of Computer Accompaniment," *ICMC Proceedings,* (1988), pp. 243–249.
R. Dannenburg et al., "Following an Improvisation in Real Time," *ICMC Proceedings,* ICMA pub., (1987), pp. 241–248.
R. Dannenberg, "An On–Line Algorithm for Real–Time Accompaniment," Copyright 1985 Roger B. Dannenberg, *ICMC '84 Proceedings,* pp. 193–198.
R. Fenno, "Music Study System," *MacWorld,* 4th Qtr. 1994.
L. Grubb et al., "Automated Accompaniment of Musical Ensembles," *Proceedings of 12th National Conference on Artificial Intelligence,* (1994), pp. 94–99.
J. Lifton, "Some Technical and Aesthetic Considerations in Software for Live Interactive Performance," *ICMC '85 Proceedings,* (1985), pp. 303–306.
M. Max McKee, "Vivace Personal Accompanist, " *Bandworld,* Oct. Dec. 1994.
"Music to Your Ears," *Rolling Stone,* Dec. 1, 1994.
M. Puckette et al., "Score following in practice," *ICMC Proceedings,* ICMA pub. (1992), pp. 182–185.
E. Rideout, "Cool School," *Interface,* Jan. 1995, p. 24.
B. Vercoe, "The Synthetic Performer in the Context of Live Performance," *ICMC '84 Proceedings,* (1984), pp. 199–200.
B. Vercoe et al., "Synthetic Rehearsal: Training the Synthetic Performer," *ICMC '85 Proceedings,* (1985), pp. 275–289.
F. Weinstock, "Demonstration of *Concerto Accompanist,* a Program for the Macintosh Computer," *Demonstration of Concerto Accompanist,* Sep. 1993, pp. 1–3.
"Welcome to the 'Vivace' Room," *Musical Merchandise Review,* Jan. 1995, pp. 124–126.

APPARATUS AND METHOD FOR ANALYZING VOCAL AUDIO DATA TO PROVIDE ACCOMPANIMENT TO A VOCALIST

FIELD OF THE INVENTION

The present invention relates to a method and associated apparatus for providing automated accompaniment to a solo vocal performance.

BACKGROUND OF THE INVENTION

U.S. Pat. No. 4,745,836, issued May 24, 1988, to Dannenberg, describes a computer system which provides the ability to synchronize to and accompany a live performer. The system converts a portion of a performance into a performance sound, compares the performance sound and a performance score, and if a predetermined match exists between the performance sound and the score provides accompaniment for the performance. The accompaniment score is typically combined with the performance.

Dannenberg teaches an algorithm which compares the performance and the performance score on an event by event basis, compensating for the omission or inclusion of a note not in the performance score, improper execution of a note or departures from the score timing.

The performance may be heard live directly or may emerge from a synthesizer means with the accompaniment. Dannenberg provides matching means which receive both a machine-readable version of the audible performance and a machine-readable version of the performance score. When a match exists within predetermined parameters, a signal is passed to an accompaniment means, which also receives the accompaniment score, and subsequently the synthesizer, which receives the accompaniment with or without the performance sound.

While Dannenberg describes a system which can synchronize to and accompany a live performer, in practice the system tends to lag behind the performer due to processing delays within the system. Further, the system relies only upon the pitch of the notes of the soloist performance and does not readily track a pitch which falls between standard note pitches, nor does the system provide for the weighting of a series of events by their attributes of pitch, duration, and real event time.

Therefore, there is a need for an improved means of providing accompaniment for a smooth natural performance in a robust, effective time coordinated manner that eliminates the unnatural and "jumpy" tendency of the following apparent in the Dannenberg method.

SUMMARY OF THE INVENTION

The present invention provides a system for interpreting the requests and performance of a vocal soloist, stated in the parlance of the musician and within the context of a specific published edition of music the soloist is using, to control the performance of a digitized musical accompaniment. Sound events and their associated attributes are extracted from the soloist vocal performance and are numerically encoded. The pitch, duration and event type of the encoded sound events are then compared to a desired sequence of the performance score to determine if a match exists between the soloist performance and the performance score. Variations in pitch due to vibrato are distinguished from changes in pitch due to the soloist moving from one note to another in the performance score. If a match exists between the soloist vocal performance and the performance score, the system instructs a music synthesizer module to provide an audible accompaniment for the vocal soloist.

DETAILED DESCRIPTION OF THE PREFERRED EMBODIMENTS

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

In the following detailed description of the preferred embodiments, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

The present invention provides a system and method for a comparison between a performance and a performance score in order to provide coordinated accompaniment with the performance. A system with generally the same objective is described in U.S. Pat. No. 4,745,836, issued May 24, 1988, to Dannenberg, which is herein incorporated by reference. Other portions of the present invention are described in U.S. Pat. No. 5,585,585, issued Dec. 17, 1996, to Paulson et al., which is herein incorporated by reference.

Figure 1:
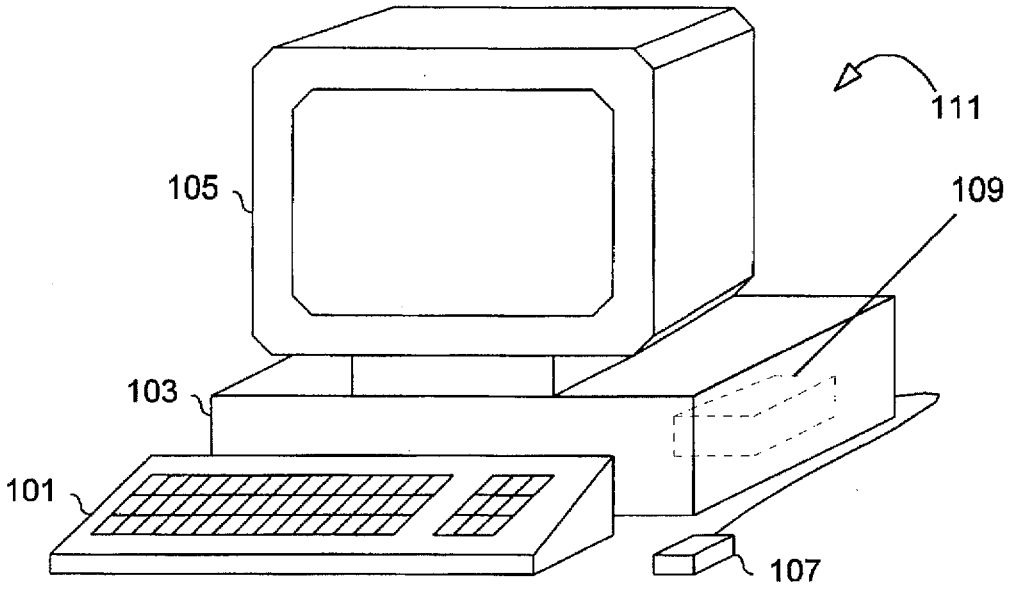
FIG. 1 is a perspective view of the components of a digital computer according to the present invention.

FIG. 1 shows the components of a computer workstation 111 that may be used with the system. The workstation includes a keyboard 101 by which a user may input data into a system, a computer chassis 103 which holds electrical components and peripherals, a screen display 105 by which information is displayed to the operator, and a pointing device 107, typically a mouse, with the system components logically connected to each other via internal system bus within the computer. Automated accompaniment software which provides control and analysis functions to additional system components connected to the workstation is executed by a central processing unit 109 within the workstation 111.

Figure 2:
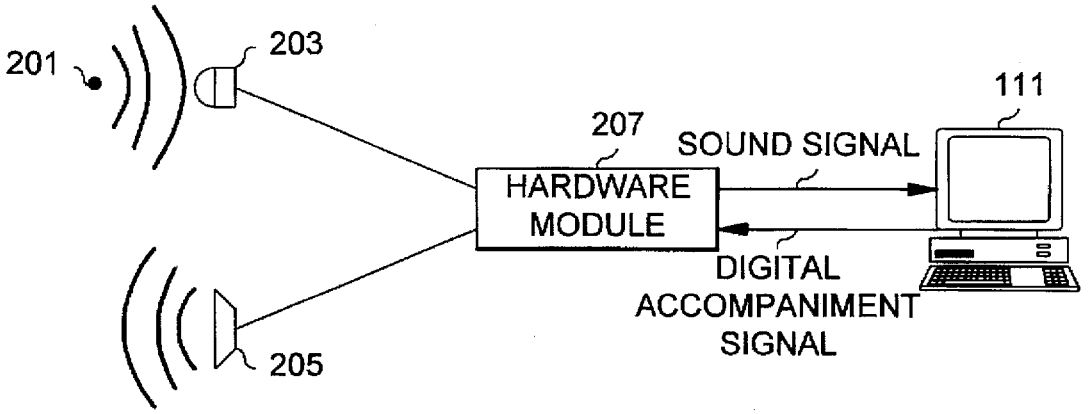
FIG. 2 is a block diagram of the high level logical organization of an accompaniment system according to the present invention.

The workstation 111 is used as part of a preferred automated accompaniment system as shown in FIG. 2. A microphone 203 preferably detects sounds emanating from a sound source 201. The sound signal is typically transmitted to a hardware module 207 where it is converted to a digital form. The digital signal is then sent to the workstation 111, where it is compared with a performance score and a digital accompaniment signal is generated. The digital accompaniment signal is then sent back to the hardware module 207 where the digital signal is converted to an analog sound signal which is then typically applied to a speaker 205. It will be recognized that the sound signal may be processed within the hardware module 207 without departing from the invention. It will further be recognized that other sound generation means such as headphones may be substituted for the speaker 205.

Figure 5:
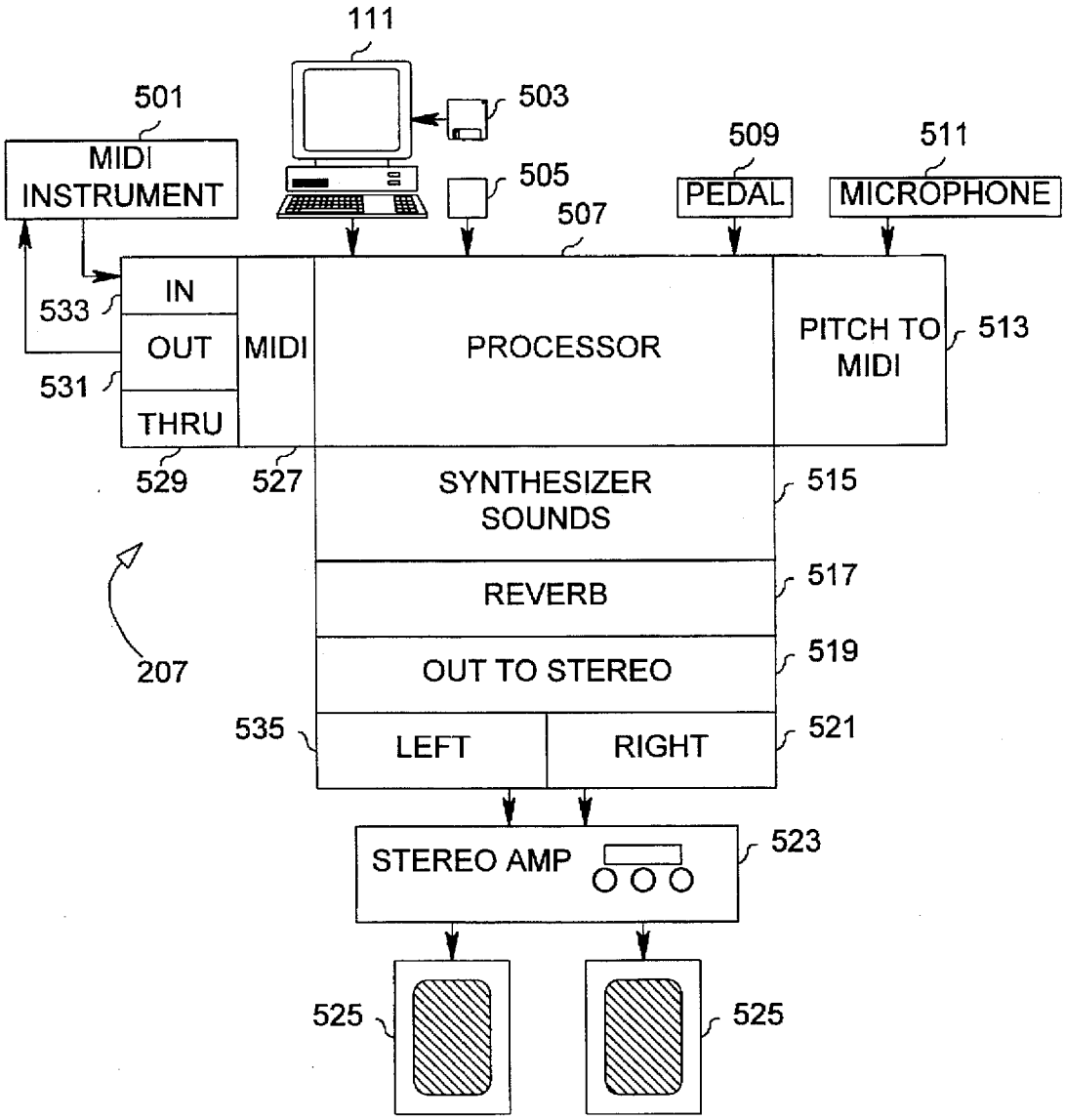
FIG. 5 is a block diagram of the high level hardware organization of an accompaniment system according to the present invention.

A high level view of the hardware module 207 for a preferred automated accompaniment system is given in FIG. 5. A musical instrument digital interface (MIDI) compatible instrument 501 is connected to a processor 507 through a MIDI controller 527 having an input port 533, output port 531, and a through port 529. The MIDI instrument 501 may connect directly to the automated accompaniment system. Alternatively, a microphone 511 may be connected to a pitch-to-MIDI converter 513 which in turn is connected to processor 507. The workstation 111 is connected to the processor 507 and is used to transmit musical performance score content 503, stored on removable or fixed media, and other information to the processor 507. A data cartridge 505 is used to prevent unauthorized copying of content 503. Once the processor 507 has the soloist input and musical performance score content 503, the digital signals for an appropriate accompaniment are generated and then typically sent to a synthesizer module 515. The synthesizer interprets the digital signals and provides an analog sound signal which has reverberation applied to it by a reverb unit 517. The analog sound signal is sent through a stereo module 519 which splits the signal into a left channel 535 and a right channel 521, which then typically are sent through a stereo signal amplifier 523 and which then can be heard through speakers 525. Pedal input 509 provides an easy way for a user to issue tempo, start and stop instructions.

Figure 6:
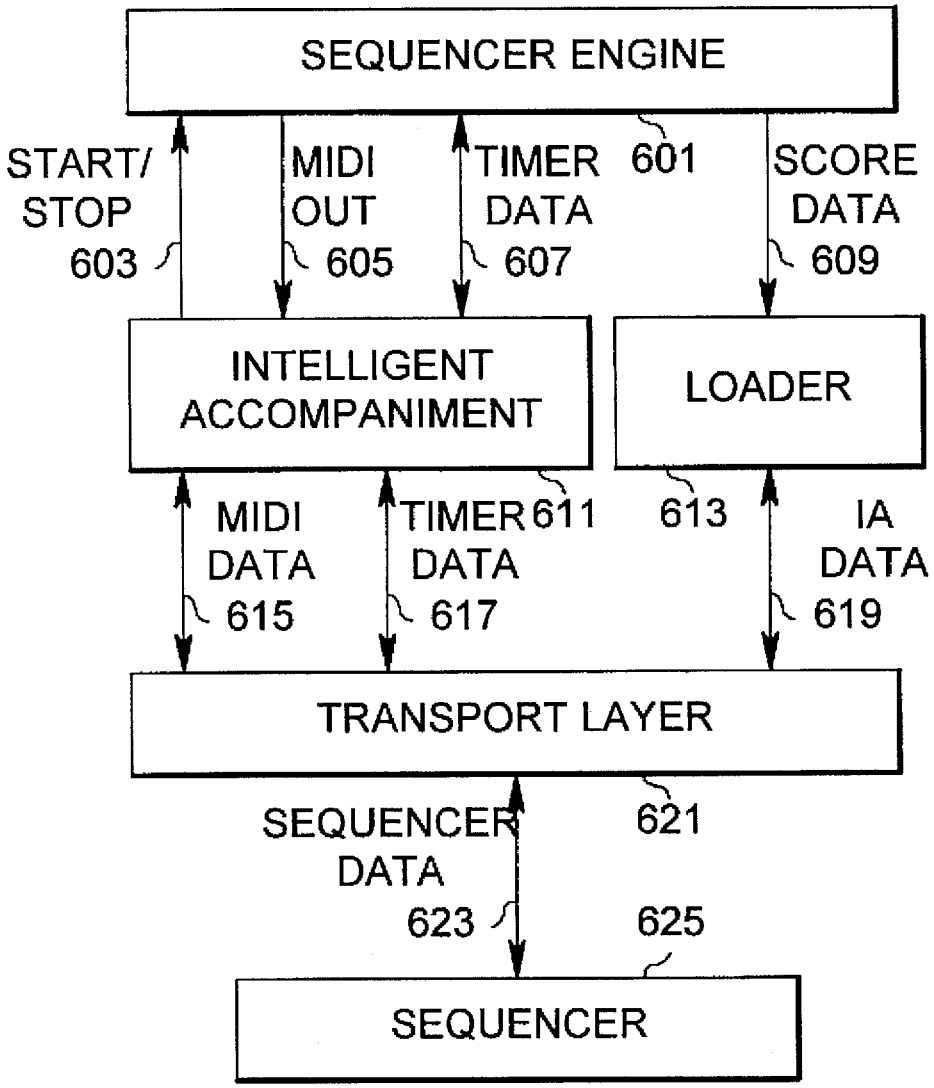
FIG. 6 is a block diagram of a high level data flow overview according to the present invention.

The data flow between logical elements of a preferred automated accompaniment system is described in FIG. 6. A sequencer engine 601 outputs MIDI data based at the current tempo and current position within the musical performance score, adjusts the current tempo based on a tempo map, sets a sequence position based on a repeats map, and filters out unwanted instrumentation. The sequencer engine 601 typically receives musical note start and stop data 603 and timer data 607 from an automated accompaniment module 611, and sends corresponding MIDI out data 605 back to the automated accompaniment module 611. The sequencer engine 601 further sends musical score data 609 to a loader 613 which sends and receives such information as presets, reverb settings, and tunings data 619 to and from the transport layer 621. The transport layer 621 further sends and receives MIDI data 615 and timer data 617 to and from the automated accompaniment module 611. A sequencer 625 can preferably send and receive sequencer data 623, which includes MIDI data 615, timer data 617, and automated accompaniment data 619, to and from the automated accompaniment system through the transport layer 621.

Figure 7:
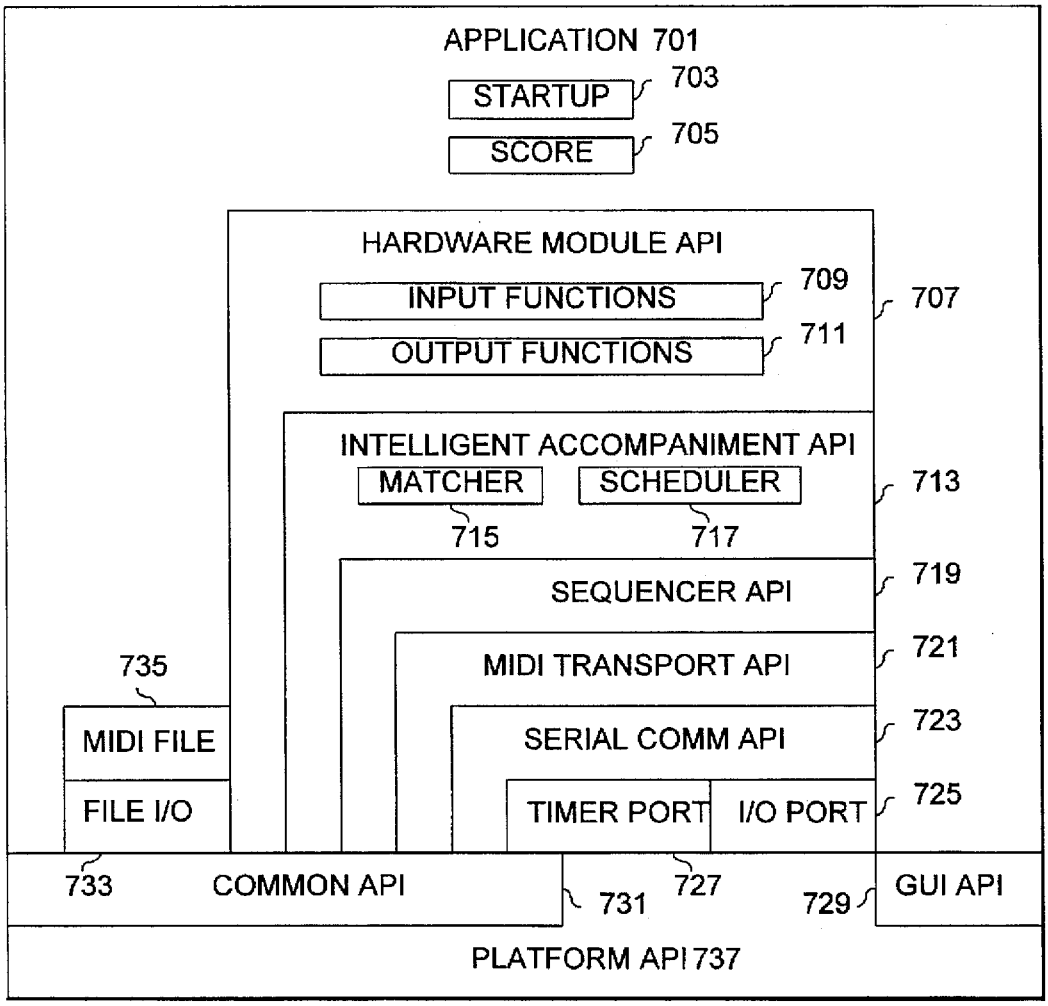
FIG. 7 is a block diagram of a high level interface between software modules according to the present invention.

The interface between the software modules of a preferred automated accompaniment system is illustrated in FIG. 7. A high level application 701 having a startup object 703 and a score object 705 interact with a graphic user interface (GUI) application program interface (API) 729 and a common API 731. The common API 731 provides operating system functions that are isolated from platform-specific function calls, such as memory allocation, basic file input and output (I/O), and timer functions. A file I/O object 733 interacts with the common API 731 to provide MIDI file functions 735. A platform API 737 is used as basis for the common API 731 and GUI API 729 and also interacts with timer port object 727 and I/O port object 725. The platform API 737 provides hardware platform-specific API functions. A serial communication API 723 interacts with the timer port object 727 and I/O port object 725, and is used as a basis for a MIDI transport API 721 which provides standard MIDI file loading, saving, and parsing functions. A sequencer API 719 comprises a superset of and is derived from the MIDI transport API 721 and provides basic MIDI sequencer capabilities such as loading or saving a file, playing a file including start, stop, and pause functions, positioning, muting, and tempo adjustment. An automated accompaniment API 713 comprises a superset of and is derived from the sequencer API 719 and adds automated accompaniment matching capabilities to the sequencer. A hardware module API 707 having input functions 709 and output functions 711 comprises a superset of and is derived from the automated accompaniment API 713 and adds the hardware module protocol to the object. The automated accompaniment application 701 is the main platform independent application containing functions to respond to user commands and requests and to handle and display data.

Figure 8:
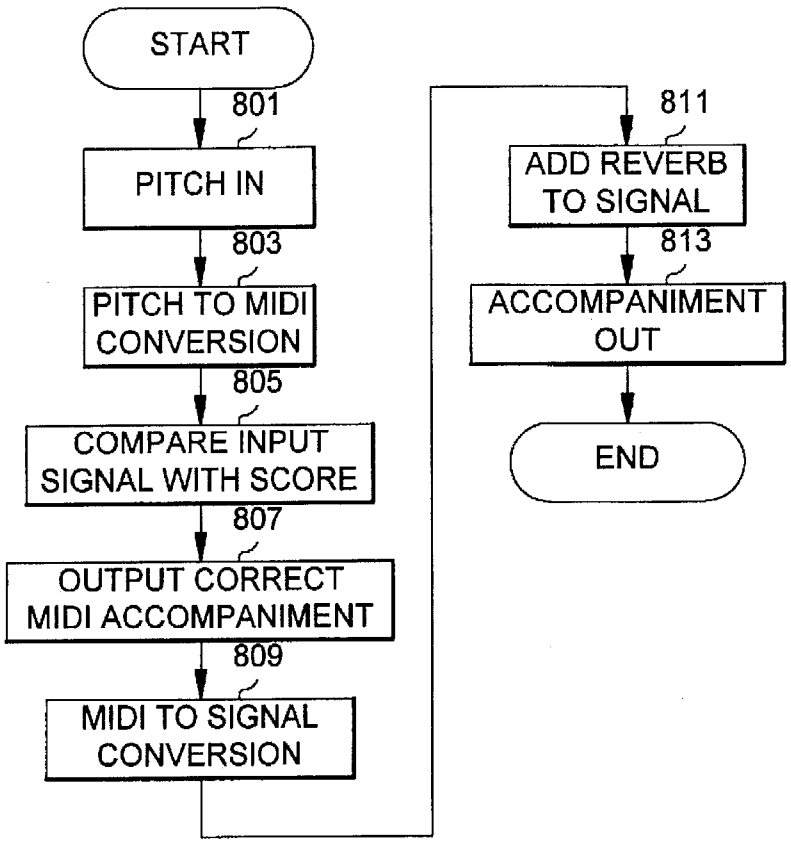
FIG. 8 is a flow diagram of a high level interface between software modules according to the present invention.

FIG. 8 describes the flow control of the overall operation of the preferred automated accompaniment system shown in FIG. 2. At 801 a pitch is detected by the system and converted to MIDI format input signal at 803. The input signal is sent from the hardware module 207 to the workstation 111 (FIG. 2) and compared with a musical performance score at 805 and a corresponding MIDI accompaniment output signal is generated and output at 807. The MIDI output signal is converted back to an analog sound signal at 809, reverberation is added at 811, and the final sound signal is output to a speaker at 813.

Figure 9:
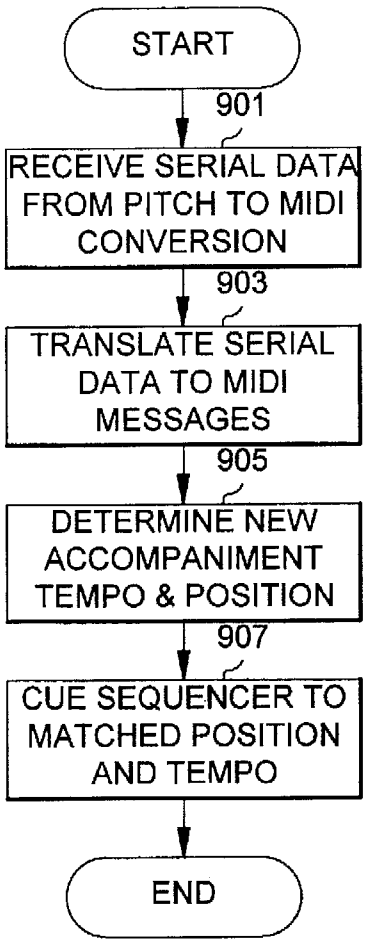
FIG. 9 is a flow diagram of a computerized music data input process according to the present invention.

FIG. 9 shows the input process flow control of FIG. 8. At 901 serial data is received from the pitch to MIDI converter and translated into MIDI messages at 903. A new accompaniment, tempo, and position are determined at 905 and a sequencer cue to the matched position and tempo generated at 907.

Figure 10:
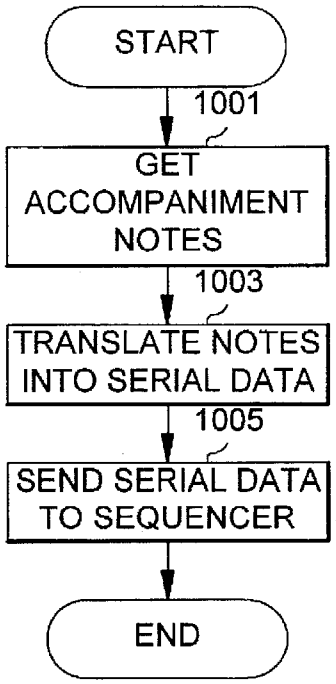
FIG. 10 is a flow diagram of a computerized music data output process according to the present invention.

FIG. 10 shows the output process flow control of FIG. 8. At 1001 accompaniment notes are received and translated into serial data at 1003. The serial data is then sent to the sequencer at 1005.

Figure 11:
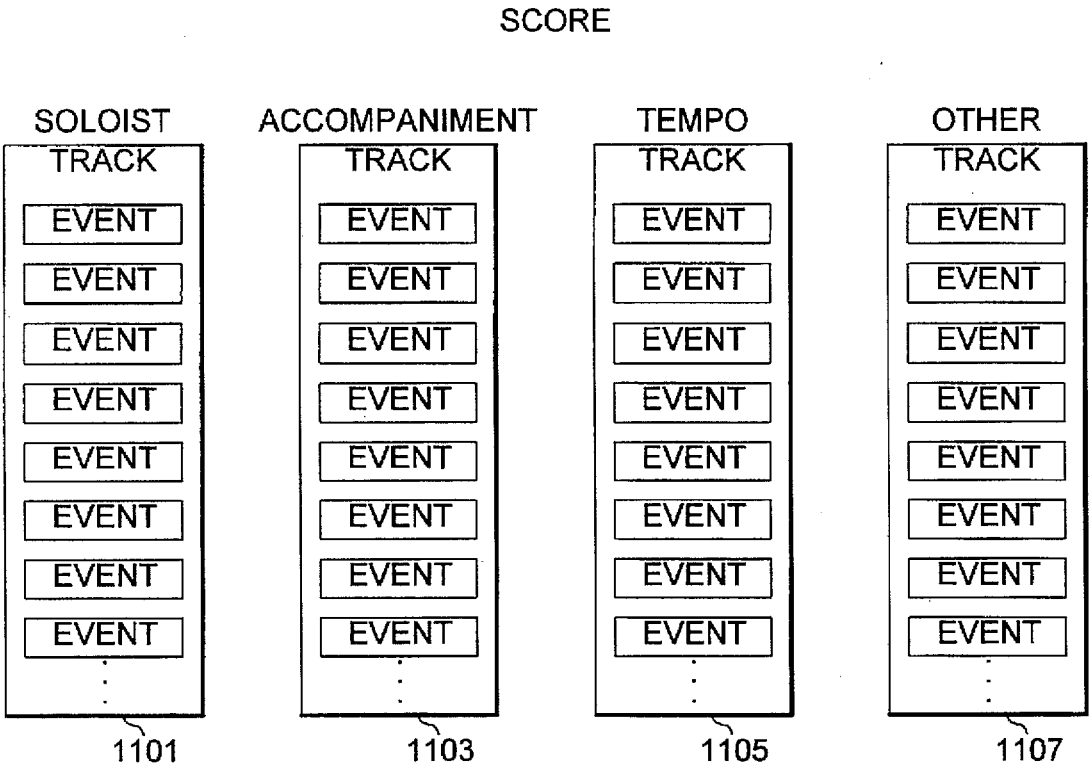
FIG. 11 is a block diagram of data objects for a musical performance score according to the present invention.

FIG. 11 reveals data objects for a musical performance score. A score is divided into a number of tracks which correspond to a specific aspect of the score, with each track having a number of events. A soloist track 1101 contains the musical notes and rests the soloist performer plays; an accompaniment track 1103 contains the musical notes and rests for the accompaniment to the soloist track 1101; a tempo track 1105 contains the number of beats per measure and indicates tempo changes; another track 1107 contains other events of importance to the score including instrumental changes and rehearsal marks.

Figure 12:
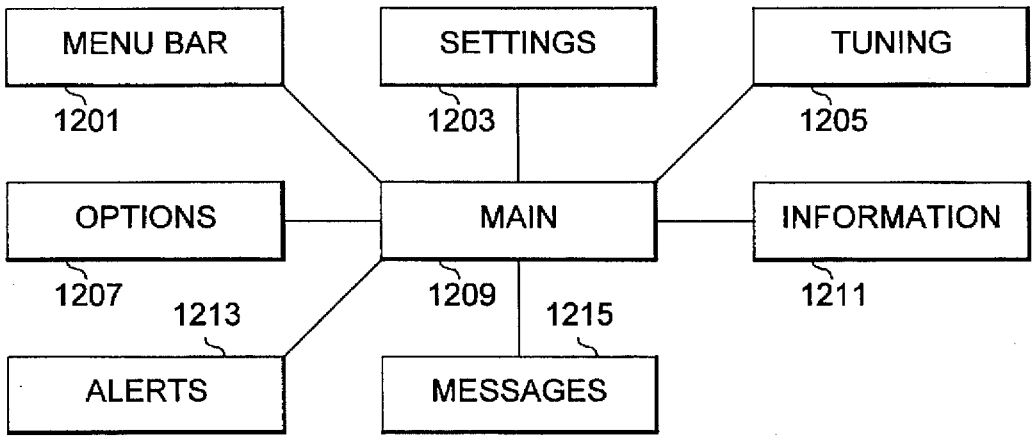
FIG. 12 is a block diagram of main software modules according to the present invention.

FIG. 12 shows preferred main software modules. A main play control module 1209 receives user input and invokes appropriate function modules in response to selections made by the user. Because the preferred software uses a GUI, the display modules are kept simple and need only invoke the system functions provided by the windowing system. A system menu bar 1201 provides operating system control functions; a settings module 1203 allows the editing of system settings; a tuning module 1205 allows a soloist to tune to the system, or the system to tune to the soloist; an options module 1203 allows the editing of user settings; an information module 1211 provides information about the system; an alerts module 1213 notifies a user of any alerts; and a messages module 1215 provides system messages to the user.

Figure 4:
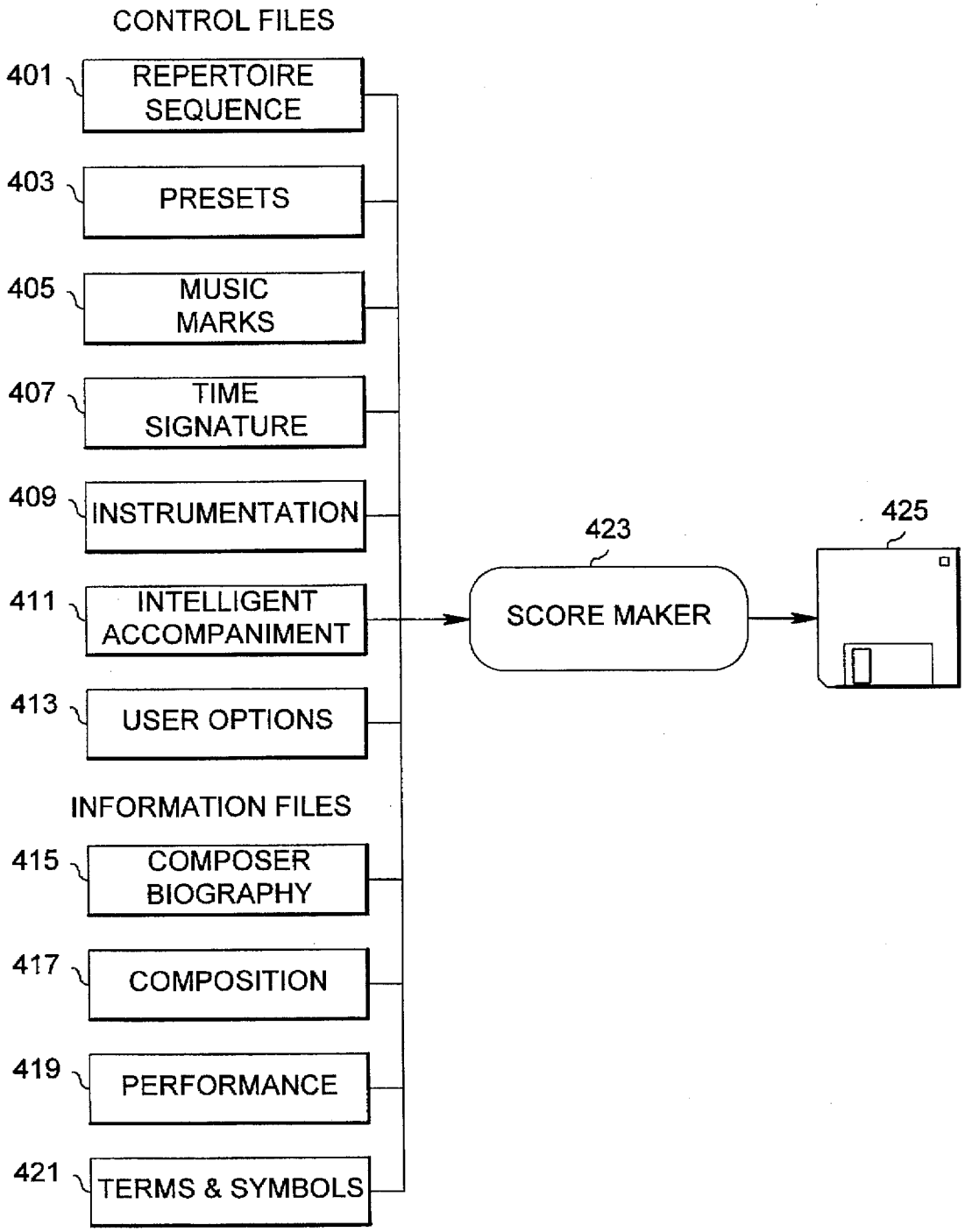
FIG. 4 is a block diagram of a file structure according to the present invention.

A repertoire file is preferably composed of a number of smaller files as shown in FIG. 4. These files are typically tailored individually for each piece of music. The files are classified as either control files or information files. The control files used by the application are preferably a repertoire sequence file 401 for the actual music accompaniment files, a presets file 403 for synthesizer presets, a music marks file 405 for rehearsal marks and other music notations, a time signature file 407 for marking the number of measures in a piece, whether there is a pickup measure, where time signature changes occur, and the number of beats in the measure as specified by the time signature, an instrumentation file 409 to turn accompanying instruments on or off, an automated accompaniment file 411 to set the default regions for automated accompaniment on or off (where in the music the accompaniment will listen to and follow the soloist), and a user options file 413 to transpose instruments and to set fine adjustments made to the timing mechanisms. The information files used by the application are preferably a composer biography file 415 for information about the composer, a composition file 417 for information about the composition, a performance file 419 containing performance instructions, and a terms and symbols file 421 containing the description of any terms used in the piece. A computerized score maker software tool 423 makes the musical performance score and assembles all control and information data files into a single repertoire file 425.

File Markers

Markers are MIDI events that provide the system with information about the structure and execution of a piece. These events are of the MIDI type Marker and are stored in "Track 0" of a standard MIDI file.

Each marker contains a text string. Markers typically do not contain any spaces. There are several types of markers required in every sequence file:

1. EOF Marker.
2. automated accompaniment Region Defaults.
3. Musical Pause Markers (fermatas, etc.).
4. Tempo Reset Markers.
5. Open and Close Window Markers.
6. Optional Octave Markers.
7. Rehearsal Markers.
8. Repeat Markers (including D.C. and D.S.).

Markers are typically placed in the sequence at the precise measure, beat and tick that each of the following events actually occurs. For events that occur on the barline, this will typically correspond to beat 1, tick 0 of the measure that begins on that barline.

There is an exception to the above rule in the case of repeat markers that occur before the first barline (in measure "zero"). If a piece contains such a repeat, then all repeats for that sequence are placed ON the barline immediately following their location in the score.

1. EOF. The location in the sequence corresponding to the final double bar in the printed score is marked with an End Of File (EOF) marker. It is simply a marker event with the text "EOF" (no quotes).

2. Automated Accompaniment Regions ON/OFF Defaults. Automated Accompaniment may be set to any integer value from 0 to 100. A marker with the text "IA=x" placed in a sequence will set the value of automated accompaniment to the number "x" at that location.

3. Musical Pauses. Musical pauses include fermatas (over notes, rest or cadenzas), tenutos, commas, hash marks and some double bars. If there is an option for the soloist to pause or hold a note before continuing in tempo, a Pause Marker is typically inserted into the file. Musical Pauses occurring in the middle of a section where the accompaniment is playing entirely by itself typically do not need to be marked with Pause markers.

Pause markers come in pairs: a pause start and a pause end. When the system comes to a pause start marker, all MIDI events freeze. All accompaniment notes that are currently playing will hold. When the signal to continue is received, the system jumps immediately to the pause end marker and resumes playback. Any MIDI events that occur in the sequence between the pause start and end markers will be played "simultaneously" when playback resumes. For this reason all audible MIDI events are typically eliminated from the pause region. An exception to this rule is soloist cadenza notes, which are only audible when the user is listening rather than playing along.

4. Tempo Reset. These markers are used to force the system to reset itself to the current tempo recorded in the sequence tempo map or any edited tempos as specified by the user. This marker typically causes a reset whether automated accompaniment is ON or OFF. The text for this marker is preferably "TR" (no quotes).

5. Open and Close Windows. These markers are used to denote sections of music where the accompaniment is holding notes or resting during rhythmic beats that the soloist is playing alone. These regions are referred to as "window regions". The markers instruct the system to "listen" and "follow" more closely than usual in these window regions, so that when the accompaniment comes back in, it enters precisely with the soloist.

6. Optional Octave. These markers are used where the music indicates that the soloist may optionally play at a higher or lower octave.

7. Rehearsal Marks. Rehearsal Marks are letters, numbers or text which appear in the sheet music to assist the soloist in locating a particular passage. Each Rehearsal Mark appearing in the soloist's music may be included in the sequence file using a MIDI Marker event.

8. Repeat Markers. Repeat Markers are MIDI events that provide the system with information about the structure of a piece. Repeat Markers include markers for repeated sections, multiple endings, as well as Da Capo, Del Segno and Coda sections.

Vocal Following

Automatically providing an accompaniment for a vocal soloist is more difficult that providing accompaniment for an instrumental soloist due to the nature of vocal performances. Vocal soloists typically introduce variations in pitch, known as vibrato, for notes which are sustained for any length of time. Vibrato is typically used freely in order to increase the emotional quality of the tone. Most singers use the term vibrato for a slightly noticeable wavering of the tone, as opposed to tremolo, which may be an excessive vibrato sufficient to cause a noticeable wobble in the pitch. However, variations in pitch due to vibrato may be substantial enough with some soloists to range up or down an interval of a semitone, or even more. A semitone is one-half of a whole tone, and is the smallest pitch interval in traditional Western music. An octave consists of twelve semitones. In order to provide an accurate accompaniment, the present invention detects variations in pitch due to vibrato or tremolo, and distinguishes them from changes in pitch due to the soloist moving from one note to another in the performance score. It will be recognized that the present invention may detect and accommodate vibrato and other pitch variations during instrumental performances, as well as vocal performances, without loss of generality.

Vocal Event Filtering

Figure 17:
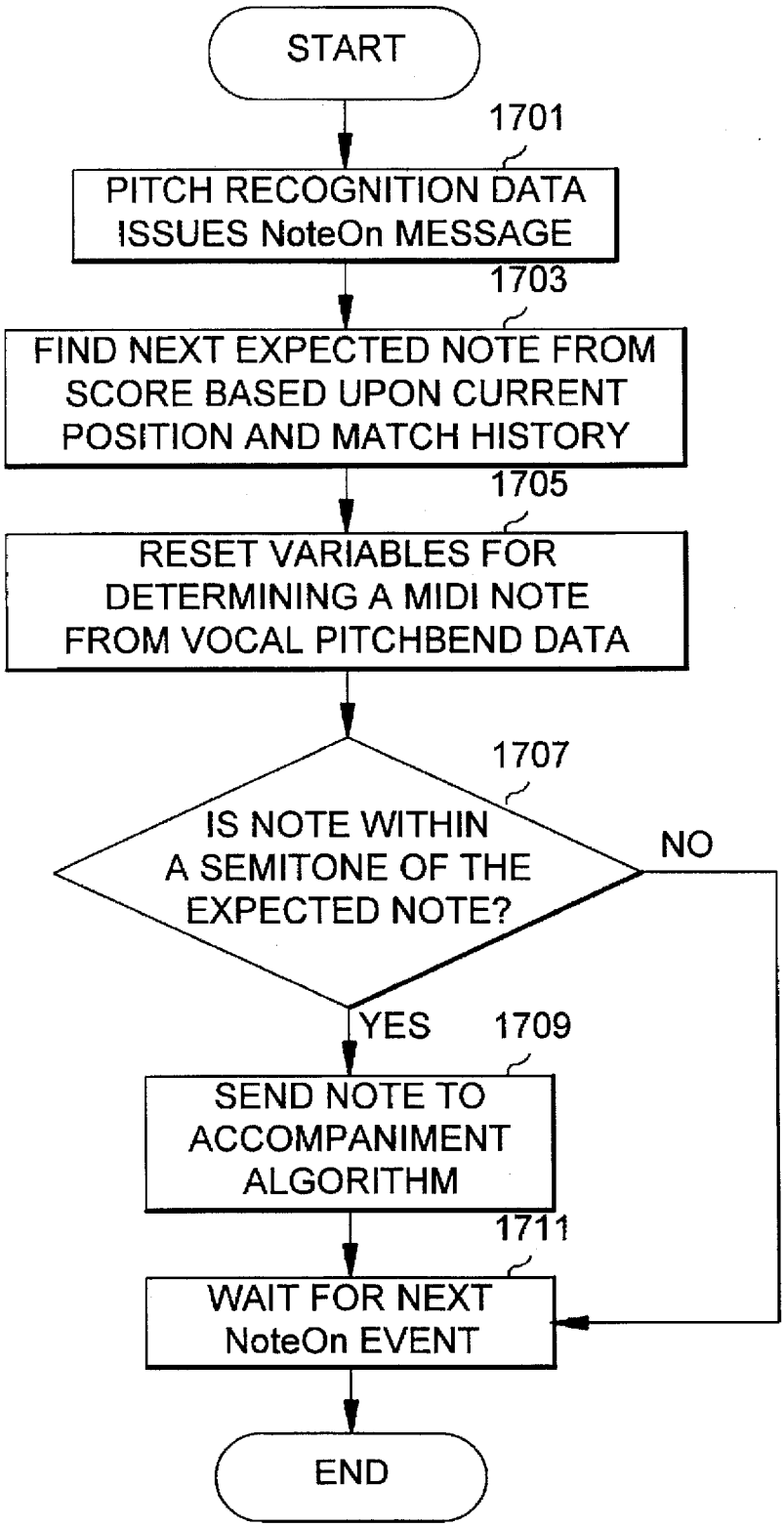
FIG. 17 is a flow diagram of a vocal event filtering process according to the present invention.

In the preferred embodiment of the present invention, vocal event filtering is based upon MIDI NoteOn and PitchBend events. The process for matching an incoming note of the soloist performance with a note of the performance score is shown in FIG. 17. At 1701, the pitch-to-MIDI converter, shown at 513 in FIG. 5, issues a MIDI NoteOn message to provide a clear indication of a vocal event. A vocal event indicates where a vocalist intends to sing a note that could be matched in the performance score. Subsequent vocal events which are detected by MIDI PitchBend data are more difficult to detect and therefore are less reliable. It will be recognized that a more tightly coupled pitch-recognition and automated accompaniment process may use event information such as amplitude and other signal characteristics that could help determine the correct timing of a vocal event without loss of generality.

Figure 3:
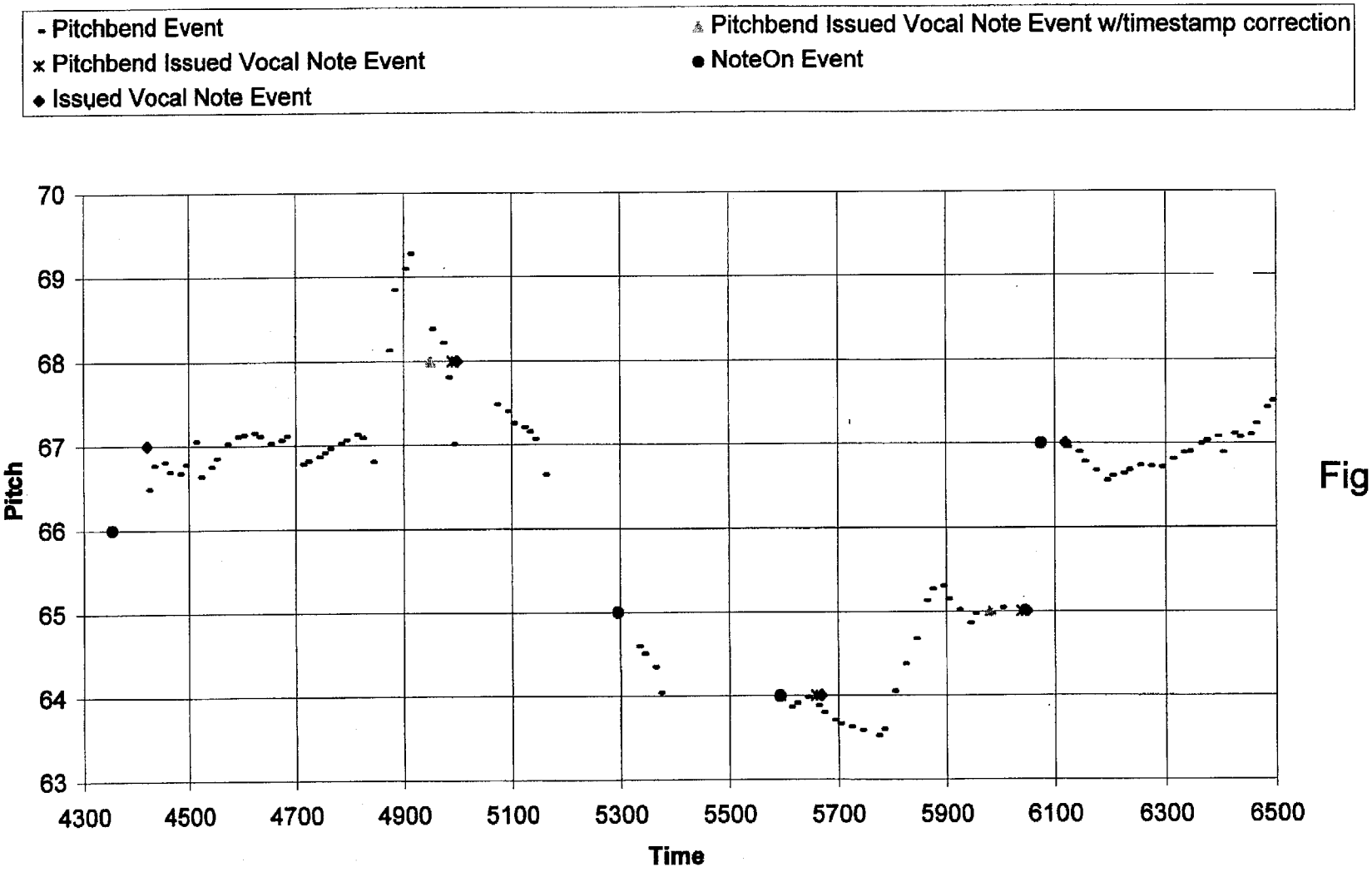
FIG. 3 is a graphical representation of musical instrument digital interface (MIDI) messages issued during a vocal performance according to the present invention.

A graphical representation of example MIDI messages issued over time during a vocal performance is shown in FIG. 3. This graphical representation of the timing of MIDI messages in relation to the detected pitches of the vocal performance is useful in understanding the following preferred process of using NoteOn and PitchBend information to provide vocal accompaniment.

After a MIDI NoteOn message is received, at 1703 the next expected note in the performance score is located preferably based upon the current position within the performance score and the match history. At 1705, variables used to determine a MIDI note from vocal pitchbend information are reset. At 1707, if the MIDI NoteOn message is within approximately a semitone of the expected note located at 1703, the note is sent at 1709 to the automated accompaniment module, shown at 611 in FIG. 6. Otherwise, the system subsequently waits for the next NoteOn event at 1711. It will be recognized that the difference interval used at 1707 is not limited to approximately a semitone, and may be increased or decreased substantially without loss of generality.

Figure 18A:
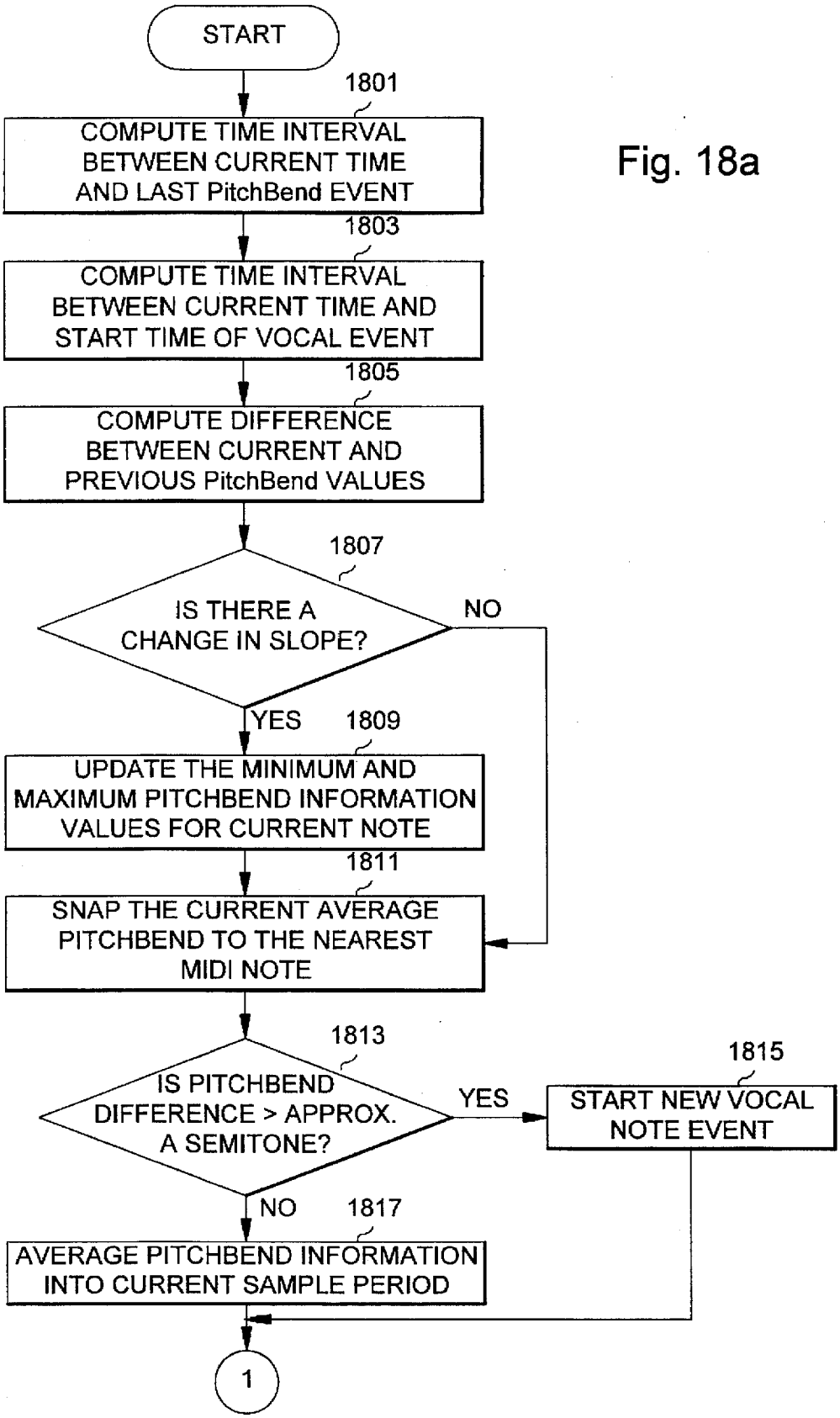
FIGS. 18*a* and 18*b* are a flow diagram of a process for determining a pitch from MIDI PitchBend information according to the present invention.
Figure 18B:
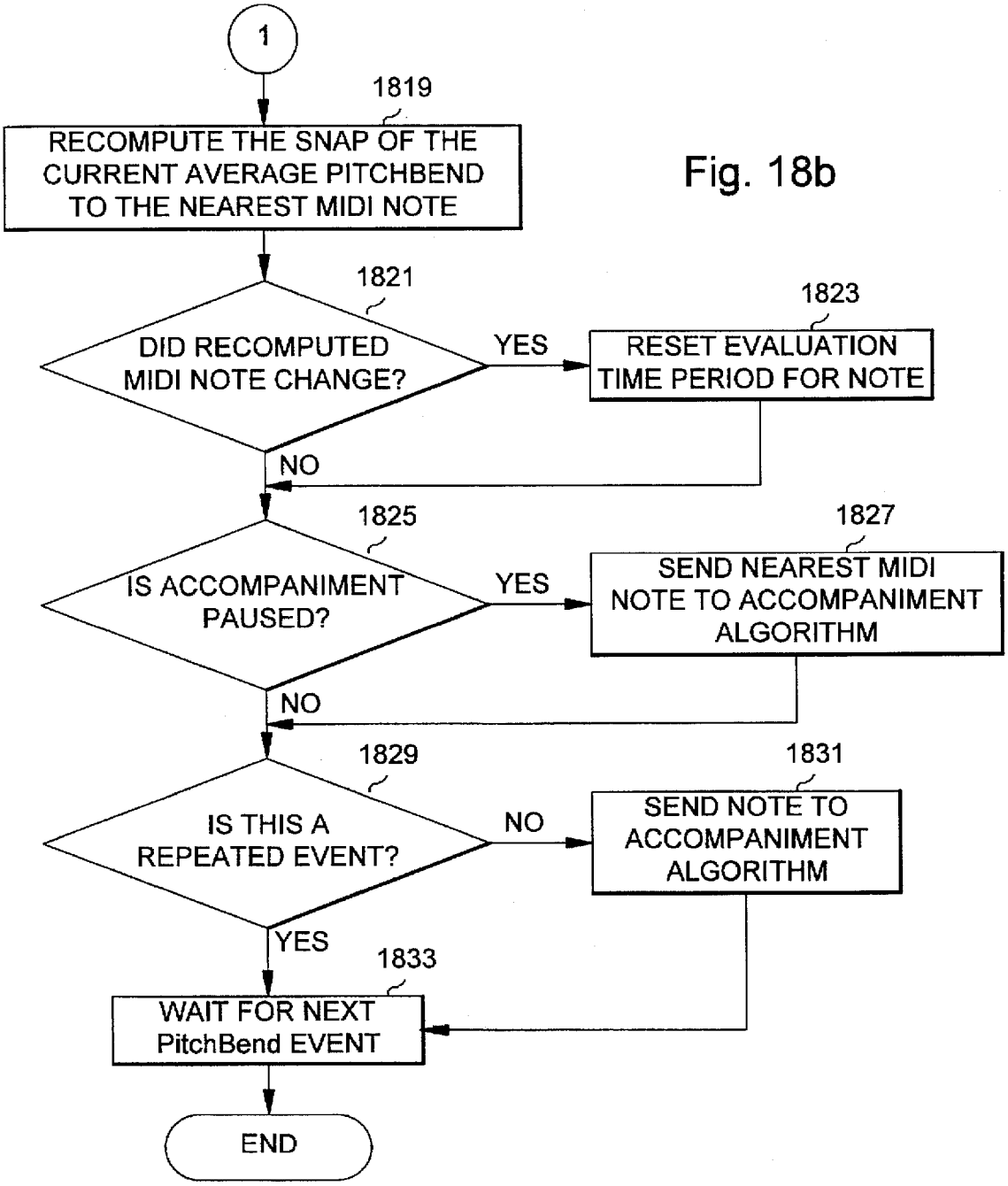

A preferred process for determining a pitch from MIDI PitchBend information is shown in FIGS. 18*a* and 18*b*. At 1801, the difference in the time interval between the current time and the time of the last PitchBend event is computed. At 1803, the difference in the time interval between the current time and the projected start time of the vocal note event is computed. At 1805, the difference between the current PitchBend value and the previously determined PitchBend value is computed. At 1807, the difference in the pitchbend information is examined to determine if there was a change in the slope, or in other words, the pitchbend changed direction. If not, control passes to 1811. Otherwise, at 1809 the minimum and maximum pitchbend information values are updated for the current vocal note event. At 1811, the average pitchbend value for the current note is moved or "snapped" to the nearest MIDI note. If at 1813 the difference between the current pitchbend and the previous pitchbend is greater than approximately a full semitone, a new vocal event is started at 1815. It will be recognized that the pitchbend difference interval used at 1813 is not limited to approximately a full semitone, and may be increased or decreased substantially without loss of generality. Otherwise, if at 1813 the difference between the current pitchbend and the previous pitchbend is not greater than approximately a full semitone, the current pitchbend information value is averaged into the sample period of the current note at 1817. At 1819, the snap of the current average pitchbend value to the nearest MIDI note is recomputed. If at 1821 it is detected there is a change between the snapped MIDI note value at 1819 and the snapped MIDI note value at 1811, the current note evaluation time period is reset at 1823. If at 1825 the automated accompaniment is paused, waiting for the soloist's next pitch, the closest MIDI note is sent at 1827 to the automated accompaniment module 611. Otherwise, if at 1829 a vocal note can be sent to the automated accompaniment module 611 and the current pitchbend event is not a repeated event, the current note is sent at 1831 to the automated accompaniment module 611. The system subsequently waits for the next MIDI PitchBend event at 1833.

User Interface

Figure 13:
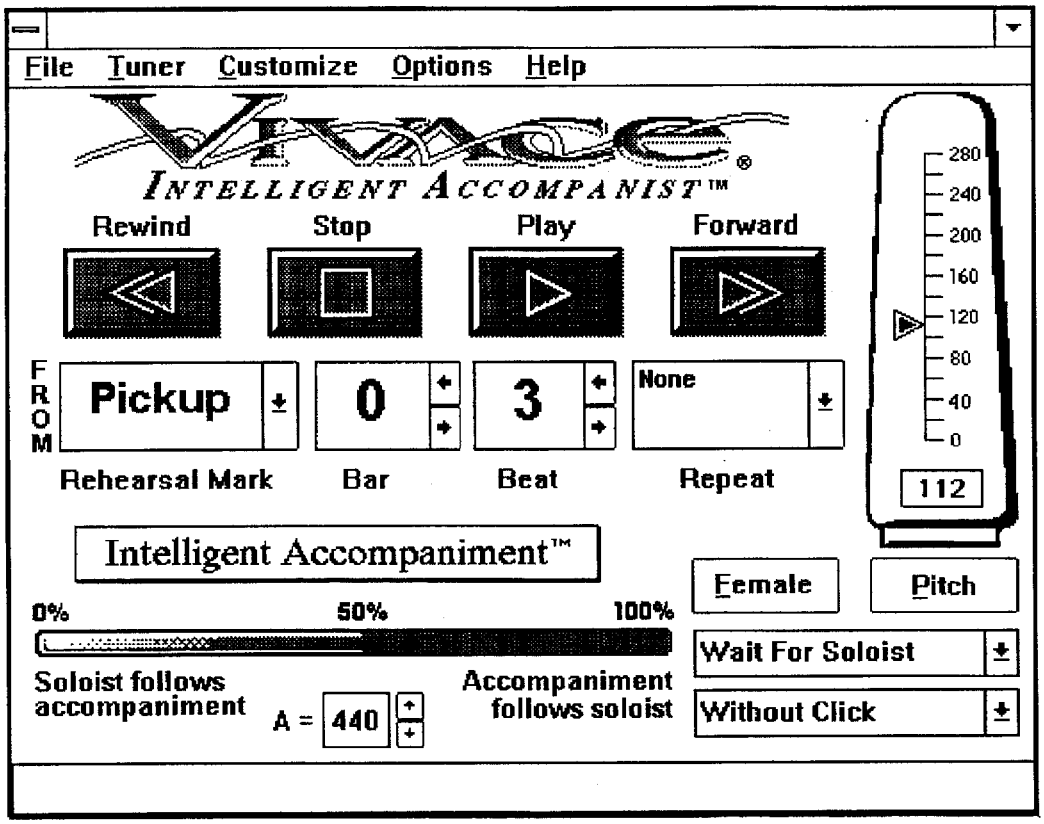
FIG. 13 is a screen display of a main play control window according to the present invention.

The present invention provides software running on the workstation which enables the vocal soloist to control the automated accompaniment to customize the performance as desired. A main play control module 1309 receives program commands and invokes specialized play functions as appropriate in response to selections made by the soloist, as shown in FIG. 13. The soloist may adjust the tuning of the accompaniment upward or downward from a default standard of 440 Hertz for a concert "A" note via an adjustable field. The soloist may make the tempo of the piece faster or slower by moving a virtual slider up or down on an on-screen metronome. The soloist may also select a virtual on-screen button to indicate to the automated accompaniment software that they are female. If soloist indicates they are female via the virtual on-screen button, the automated accompaniment software anticipates that the notes sung by the soloist will be in a range one octave higher than the pitches of the notes expected in the performance score. If the soloist is female, the automated accompaniment can perform a match between the soloist and the performance score either by adjusting the note sung by the soloist down by one octave or by adjusting the expected note in the performance score up by one octave. It will be recognized that an alternative embodiment of the present invention is to create a performance score which expects a female soloist voice range and instead provides a virtual on-screen "male" button to indicate that the notes sung by the soloist will be in a range one octave lower than the pitches of the notes in the performance score.

Figure 16:
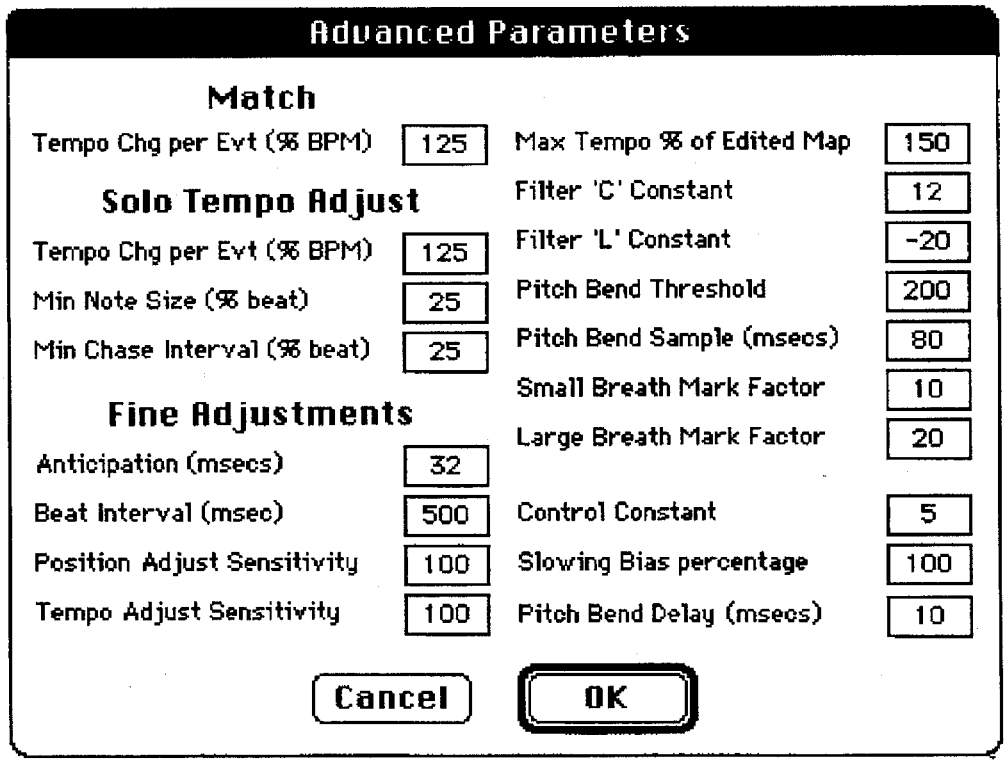
FIG. 16 is a screen display of an advanced parameters window according to the present invention.

The soloist may adjust many parameters of the vocal accompaniment by the advanced parameters window shown in FIG. 16. Parameters which may be adjusted include: a tempo change per event, given as a percentage beats per minute (BPM); a minimum note size and a minimum chase interval, both given as a percentage of a beat; an anticipation factor and a beat interval, both given in milliseconds (msec); a position adjust sensitivity and a tempo adjust sensitivity; and other various control factors.

Figure 14:
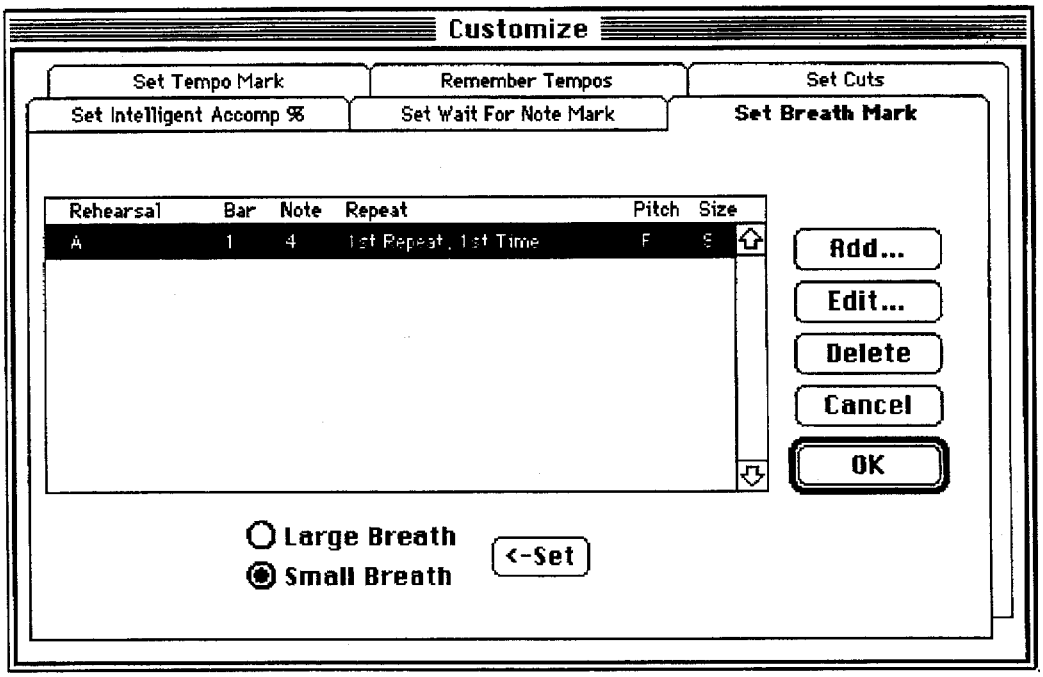
FIG. 14 is a screen display of a customize window according to the present invention.
Figure 15:
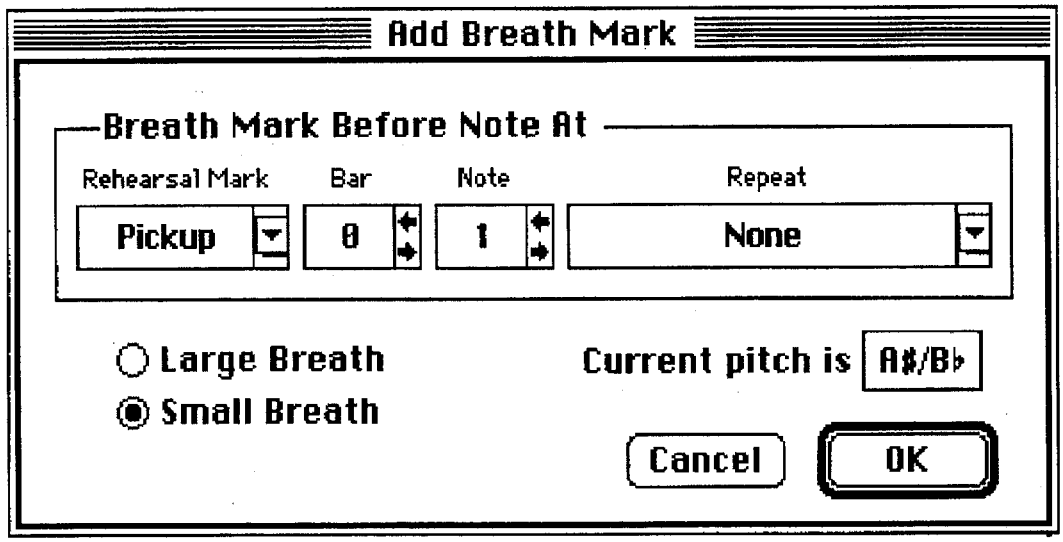
FIG. 15 is a screen display of an add breath mark window according to the present invention.

FIG. 14 shows a screen display of a preferred customize window as shown to the soloist. From this window the soloist may edit a list of breath mark locations within the performance score. Every breath mark receives its own indication in the performance score, and is displayed in a breath mark list with the repeats designated by the soloist. The soloist sets a breath mark to the music by using the window shown by the screen display of FIG. 15. The soloist can indicate either a large breath or a small breath. The soloist then specifies the location within the performance score to add a breath mark, then by selecting the on-screen OK button adds the breath mark to the list and returns to the customize window of FIG. 14.

When the automated accompaniment encounters a user-insertable breath mark event, it causes the current edited tempo to be reduced by a certain percentage for a brief period of time. More specifically, a large breath mark may reduce the current tempo by approximately 20 percent, and a small breath mark by approximately 10 percent. A breath mark is typically placed before the note that will be used to return to tempo with. The period of time that is reduced is preferably one full beat or the time between scored soloist notes, whichever is smaller. If the period of time is smaller than one beat, then the percentage to reduce the tempo by is preferably scaled to keep the overall time consistent with reducing the tempo by 10 percent or 20 percent for one full beat.

Remember Tempos

The present invention allows a soloist to customize the automated accompaniment by entering a tempo preferences and changes for any location within the performance score. A custom tempos may be entered from the keyboard of the workstation, or "tapped" on the beat of the music by the soloist using a keyboard key, foot switch, or some other equivalent tapping means. One difficulty in entering tempo information by tapping on each beat of the music is that the soloist may intend a gradual change in tempos between taps which is not reflected by the taps. Thus, in a section of performance score where a soloist could insert tempo information by tapping, subdivisions of the beat are lost such that executing the tempo changes on a beat basis could cause a step-wise tempo change. This is evident especially in Largo tempos. One possible solution is to interpolate steps between tempo changes, either linearly or by using a curve-fitting function such as a spline function to smooth the tempo changes over the tapped section of the score. However, because subdivisions of the beat are lost, it may not be always clear that a soloist intends to smoothly accelerando or retard, but may wish to step-wise tempo change. A solution to this problem is to allow the soloist to subdivide tapping, or to require that non-smooth changes in tempo be added through a separate function.

The present invention provides a way to interpolate steps between taps. A preferred process of interpolating steps between taps using a curve-fitting function is given below:

```
CTempoChangeEventPtr curEvt;  //new tapped event, passed in
                              from sequencer;
long curTempo = gSequencer—>GetTempo();   //current tempo the
                                          sequencer is at (y
                                          value)
long RampFromTempo, RampToTempo;          //next two points in
                                          spline (y values)
long RampFromTime, RampToTime;            //next two points in
                                          spline (x values)
double Ramp_p;                            //spline p-constant
                                          (ref. Sedgwick)
RampFromTempo = RampToTempo = curEvt—>TempoChange;
RampFromTime = RampToTime = curEvt—>DeltaTime;
Ramp_p = 0.0;
CTempoChangeEventPtr nextEvt =
(CTempoChangeEventPtr)usrTrk—>GetNextEventAt (curEvt—>
    DeltaTime+1);
if (nextEvt != NULL)
{
    RampToTempo = nextEvt—>TempoChange;
    RampToTime = nextEvt—>DeltaTime;
    double y_diff = RampToTime − RampFromTime;
    double x0_diff = RampFromTempo − curTempo;
    double x1_diff = RampToTempo − RampFromTempo;
    Ramp_p = (3.0 * (x1_diff − x0_diff)) /
        (2.0 * y_diff * y_diff);
}
At each interrupt interval:
long curTime = gSequencer—>GetCurrentTime();   //current time
                                               the sequencer
                                               is at (x value)
if ((RampToTime > RampFromTime) && (RampToTime >= curTime))
{
    double y_diff = RampToTime − RampFromTime;
    double t = double(curTime − RampFromTime) / y_diff;
    double inv_t = 1.0 − t;
    double newTpo = (t * RampToTempo) + (inv_t *
        RampFromTempo) + ((y_diff * y_diff * inv_t
        Ramp_p) / 6.0);
    EditTempoMap((midiTempo)newTpo);   //set the new
                                       splined tempo.
}
```

It will be recognized that other interpolation functions for integrated the steps between taps may be used with the present invention without loss of generality.

Filtering Process and Data Structures

A preferred vocal event filtering process and corresponding data structures are given below:

```
NoteOn( u32bit vocalTime, u8bit vocalNote)
    //Where vocalTime is the reference time in msecs that
    the pitched portion of the incoming signal occurred.
    The vocalNote is the MIDI note of that pitch. The
    following method assumes 682 pitchbend steps per
    semitone.
//Find the next expected note from the score based on the
current position and match history.
    s32bit nextBend = 0;
    SoloEventPtr soloEvt = (SoloEventPtr)soloTrack—>
        GetEvent(nextExpectedPos);
    if (soloEvt) nextBend = (s32bit)((soloEvt—>Note &
        0x7F) + this—>GetTransposition() + this—>
        GetSoloTranspose()) * 682L;
//Reset variables used in the algorithm for determining a
MIDI note from vocal pitchbend data.
    vocalLastTime = vocalAveTime = vocalTime;
    vocalLastBend = vocalBend = vocalNote * 682L;
    vocalAveBend = nextBend;
    vocalDiff = 0;
    vocalLastNote = MIDI_NOTUSED;
    vocalEvalTime = 0;
    vibratoNumPeaks = 0;
    vibratoMin = vibratoMax = 0;
//If the NoteOn was close the what we are expecting, send
it to be processed by the IA algorithm.
```

-continued

```
    if (labs(vocalBend – nextBend) <= 682)
    {
        vocalLastNote = (u8bit) (nextBend / 682);
        IASequencer::NoteOnMsg(vocalAveTime, 0,
            vocalLastNote, 64);
    }
```

Determining Pitch From MIDI PitchBend Information

A preferred process of determining a pitch from MIDI PitchBend information and corresponding data structures are given below:

```
PitchBend( u32bit vocalTime, s16bit bendValue )
    //Where vocalTime is the reference time in msecs that
    the current pitchbend offset was taken. The bendValue
    is the offset based on the last NoteOn.
    vocalBend = bendValue + (vocalNote * 682);
// Compute time intervals between now and the last
pitchbend event, and now and where we think this vocal note
event started.
    s32bit timeInterval = vocalTime – vocalLastTime;
    s32bit sampleTime = vocalTime – vocalAveTime;
// Compute the difference between this and the last
pitchbend reading.
    s32bit lastVocalDiff = vocalDiff;
    vocalDiff = vocalBend – vocalLastBend;
// If the slope changed — the pitchbend changed direction —
count it as a peak, then update the minimum and maximum
pitchbend value in this vocal note event.
    if ((vocalDiff ^ lastVocalDiff) < 0)
    {
        vibratoNumPeaks++;
        if (!vibratoMin || (vibratoMin > vocalBend))
            vibratoMin = vocalBend;
        if (vibratoMin > vocalLastBend) vibratoMin =
            vocalLastBend;
        if (vibratoMax < vocalBend) vibratoMax =
            vocalBend;
        if (vibratoMax < vocalLastBend) vibratoMax =
            vocalLastBend;
    }
    boolean generateNoteOn = false;
// "Snap" the current average pitchbend in this vocal note
sample period to the nearest MIDI note.
    s32bit snapBend = ((vocalAveBend + 341) / 682) * 682;
// If the difference between this pitchbend and the last
pitchbend event is greater than almost a full semitone,
start a new vocal note event. This means a soloist has
rapidly glided to a new pitch . . . faster than vibrato.
    if (labs(vocalDiff) >= 600)
    {
        if (vocalLastNote != MIDI_NOTUSED)
            IASequencer::NoteOffMsg(currentTime, 0,
            vocalLastNote, 64);
        vocalLastNote = MIDI_NOTUSED;
        vocalLastTime = vocalAveTime = vocalTime;
        vocalLastBend = vocalBend;
        snapBend = vocalAveBend = ((vocalBend + 341) /
            682) * 682;
        vocalEvalTime = 0;
        vibratoNumPeaks = 0;
        vibratoMin = vibratoMax = 0;
    }
// else average this reading into this vocal note event's
sample period.
    else
    {
        s32bit oldSnapBend = snapBend;
        s32bit totalInterval = vocalTime – vocalAveTime;
        if (totalInterval > 180) totalInterval = 180;
        vocalAveBend = ((vocalAveBend * (totalInterval –
            timeInterval)) + (vocalBend *
            timeInterval)) / totalInterval;
// . . . and recompute the "snap".
        snapBend = ((vocalAveBend + 341) / 682) * 682;
// If the "snap" changes, then reset the time required to
evaluate this sample. vocalEvalTime is the time a sample
```

-continued

```
average needs to be stable to issue a NoteOn to the IA.
        if (snapBend != oldSnapBend)
        {
        vocalEvalTime = 0;
        if (vocalLastNote == (oldSnapBend / 682))
            vocalAveTime = vocalTime;
        }
        else vocalEvalTime += timeInterval;
    }
// If the engine is paused and waiting for the soloist's
pitch, always issue the closest MIDI note.
    if (this—>isPaused() && fWaitForSoloist)
        generateNoteOn = true;
// Otherwise if the evaluation time exceeds a period
specified by the constant "pitchbendSampleTime" — typically
80 msec — then issue the MIDI note to the IA algorithm.
    else if (vocalEvalTime >= pitchbendSampleTime)
        generateNoteOn = true;
    vocalLastTime = vocalTime;
    vocalLastBend = vocalBend;
// If a vocal note event can be issued to the automated
accompaniment and it isn't a repeated event (filtering out
effects from vibrato and vocal "scoops"), then send the
MIDI note to the IA engine.
    if (generateNoteOn && (vocalLastNote !=
        (u8bit) (snapBend / 682)))
    {
        vocalLastNote = (u8bit)(snapBend / 682);
        IASequencer::NoteOnMsg(vocalAveTime, 0,
            vocalLastNote, 64);
    }
    }
    }
```

The present invention is to be limited only in accordance with the scope of the appended claims, since others skilled in the art may devise other embodiments still within the limits of the claims.

What is claimed is:

1. A computerized method for interpreting soloist requests and soloist performance in order to control a digitized musical accompaniment performance of a performance score, the soloist performance including sound events having a pitch, time duration, and event time and type, the method comprising the steps of:

(a) converting at least a portion of the soloist performance into a sequence of sound related signals;

(b) determining a calculated pitch for a sound event by averaging together pitch variations contained in a sound event sample period of the sequence of sound related signals;

(c) comparing the calculated pitch, duration and event type of individual events of the soloist performance sound related signals to a desired sequence of the performance score to determine if a match exists between the soloist performance and the performance score; and (d) providing accompaniment for the soloist performance if a match exists between the soloist performance sound related signals and the performance score.

2. The method of claim 1 further comprising the step of effecting a match between the soloist performance and the performance score if there is a departure from the performance score by the soloist performance.

3. The method of claim 1 further comprising the step of altering the accompaniment for the soloist performance in real-time based upon post-processing of past individual events of the soloist performance sound related signals.

4. The method of claim 1 wherein the step of determining a calculated pitch for a sound event comprises using musical instrument digital interface (MIDI) NoteOn and PitchBend information.

5. The method of claim 1 further comprising the step of selecting a percentage following of the accompaniment for the soloist performance by a value, the value of the percentage having a range between 0 and 100 percent.

6. The method of claim 1 further comprising the step of filtering individual events of the soloist performance by a percentage change value, the percentage change value having a range between 0 and 100 percent, such that the individual events of the soloist performance which are inconsistent with the performance score are removed.

7. A computerized method for interpreting soloist requests and soloist performance in order to control a digitized musical accompaniment performance of a performance score, the soloist performance including sound events having a pitch, time duration, and event time and type, the method comprising the steps of:

(a) editing a breath mark associated with the performance score to indicate a change in tempo of the accompaniment at a location within the performance score;

(b) converting at least a portion of the soloist performance into a sequence of sound related signals;

(c) comparing the pitch, duration and event type of individual events of the soloist performance sound related signals to a desired sequence of the performance score to determine if a match exists between the soloist performance and the performance score; and (d) providing accompaniment for the soloist performance if a match exists between the soloist performance sound related signals and the performance score, increasing and decreasing the accompaniment tempo according to the breath mark.

8. The method of claim 7 wherein the breath mark comprises a large breath mark which reduces the tempo at the location within the performance score by 20 percent.

9. The method of claim 7 wherein the breath mark comprises a small breath mark which reduces the tempo at the location within the performance score by 10 percent.

10. The method of claim 7 further comprising the step of effecting a match between the soloist performance and the performance score if there is a departure from the performance score by the soloist performance.

11. The method of claim 7 further comprising the step of altering the accompaniment for the soloist performance in real-time based upon the post-processing of past individual events of the soloist performance sound related signals.

12. The method of claim 7 further comprising the step of selecting a percentage following of the accompaniment for the soloist performance by a value, the value of the percentage having a range between 0 and 100 percent.

13. The method of claim 7 further comprising the step of filtering individual events of the soloist performance by a percentage change value, the percentage change value having a range between 0 and 100 percent, such that individual events of the soloist performance which are inconsistent with the performance score are removed.

14. A computerized method for interpreting soloist requests and soloist performance in order to control a digitized musical accompaniment performance of a performance score, the soloist performance including sound events having a pitch, time duration, and event time and type, the method comprising the steps of:

(a) editing a tempo map associated with the performance score to indicate the tempo of the accompaniment at a location within the performance score;

(b) interpolating steps between changes of tempo of the accompaniment at the location within the performance score;

(c) converting at least a portion of the soloist performance into a sequence of sound related signals;

(d) comparing the pitch, duration and event type of individual events of the soloist performance sound related signals to a desired sequence of the performance score to determine if a match exists between the soloist performance and the performance score; and (e) providing accompaniment for the soloist performance if a match exists between the soloist performance sound related signals and the performance score, increasing and decreasing the accompaniment tempo as indicated by the soloist performance and relative to the edited tempo map.

15. The method of claim 14 further comprising the step of effecting a match between the soloist performance and the performance score if there is a departure from the performance score by the soloist performance.

16. The method of claim 14 wherein the step of editing a tempo map associated with the performance score comprises the steps of:

(a) tapping a tempo with a data input device; and (b) recording the tapped tempo as the tempo at the location within the performance score.

17. The method of claim 16 wherein the data input device comprises a foot pedal.

18. The method of claim 16 wherein the data input device comprises a keyboard.

19. The method of claim 14 wherein the step of editing a tempo map associated with the performance score comprises the steps of:

(a) the soloist playing a tempo performance;

(b) converting at least a portion of the tempo performance into a sequence of tempo related signals;

(c) analyzing the tempo related signals to derive a tempo for the tempo performance; and (d) recording the tempo for the tempo performance as the tempo at the location within the performance score.

20. The method of claim 16 wherein the step of interpolating steps between changes of tempo of the accompaniment comprises applying a curve-fitting function to smooth the tempo changes over the location within the performance score.

* * * * *